United States Patent [19]

Gerker

[11] Patent Number: 5,062,344

[45] Date of Patent: Nov. 5, 1991

[54] BOWLINE KNOT IN A BRAIDED LINE

[75] Inventor: Thomas F. Gerker, DeLand, Fla.

[73] Assignee: Sparton Corporation, Jackson, Mich.

[21] Appl. No.: 507,952

[22] Filed: Apr. 12, 1990

[51] Int. Cl.[5] ..... D04C 1/12; D07B 7/18

[52] U.S. Cl. ..... 87/8; 87/13; 289/1.5; 289/18.1

[58] Field of Search ..... 87/8, 13; 57/202, 23; 298/1.5, 16, 17, 18.1, 1.2

[56] References Cited

U.S. PATENT DOCUMENTS

| | | | |
|---|---|---|---|
| 2,600,395 | 6/1951 | Domoj et al. | 87/13 |
| 4,099,750 | 7/1978 | McGrew | 87/8 X |
| 4,962,929 | 10/1990 | Melton | 289/1.5 X |
| 4,974,488 | 12/1990 | Spralja | 87/8 |

FOREIGN PATENT DOCUMENTS

| | | | |
|---|---|---|---|
| 82172 | 7/1895 | Fed. Rep. of Germany | 87/8 |

OTHER PUBLICATIONS

Publication From Wellington Puritan Mills, Inc., pp. 1 through 8, date unknown.

*Primary Examiner*—Joseph J. Hail, III

*Attorney, Agent, or Firm*—Reising, Ethington, Barnard, Perry & Milton

[57] ABSTRACT

An eye splice is disclosed for a hollow braid type of cord for use in a parachute shroud or the like. It comprises a bight 22 in the free end of the cord which is folded back to form an eye 16 with the bight extending through braided wall of the cord at an entry point 34 and then through the center to a take-out point 36 and then through the wall to provide a cinch loop 28 of the bight extending beyond the wall. The end of the standing part of the cord passes through and the cinch loop which is tight around the standing part.

4 Claims, 2 Drawing Sheets

BOWLINE KNOT IN A BRAIDED LINE

FIELD OF THE INVENTION

This invention relates to the art of cordage; more particularly, it relates to a fixed eye splice in a cord or rope and the method of making such an eye splice.

BACKGROUND OF THE INVENTION

In the use of cordage, there are many applications where it is desirable to provide a fixed eye splice. A particular example is a parachute shroud which is typically made of cord, i.e. a small rope.

Many forms of eye splices are known in the prior art. Eye splices for diamond braid rope are described in a booklet published (date unknown) by Wellington Puritan Mills, Inc. of Madison, Georgia. A key hole splice is described for use in rope having a braided sheath in the Domoj et al Pat. No. 2,600,395 granted June 17, 1952. An eye splice in a double braided rope is described in the McGrew Pat. No. 4,099,750 granted July 11, 1978. Other eye splices for double braided ropes are described in the above cited publication by Wellington Puritan Mills, Inc. Copies of the above-cited prior art are filed with this application. The conventional bowline or bowline-on-a-bight for making an eye splice in a wide variety of cordage has been known and commonly used for a very long time.

There is a need for an improved eye splice for hollow braid cordage which is simple in construction and can be made quickly either by hand or by machinery on a production line basis. The eye splice should provide a fixed loop or eye, i.e. one which provides a high degree of resistance to slippage when placed under load.

A general object of this invention is to provide an improved eye splice for use with cordage of the hollow braid type and which overcomes certain disadvantages of the prior art.

SUMMARY OF THE INVENTION

In accordance with this invention, a fixed or non-slipping eye splice is provided for use in cordage of the hollow braid type which is of simple construction and which may be made quickly with a clean or tidy knot in the splice. In accordance with this invention, this is provided by a bight in the free end of the cord with the bight extending from an eye or loop through the wall at an entry point and through the center to a take-out point and thence through the wall, and the standing part passing through the loop of the bight with the bight being tight around the standing part.

Further, in accordance with this invention, the eye splice comprises a bight in the free end of the cord, with a loop between said bight and the standing part to form the eye of the eye splice. The bight extends through the wall on the standing part into the hollow center and thence through the wall with a length of the free end remaining in said hollow center and extending from the entry point to the take-out point.

The standing part passes through the loop of said bight and the bight is tight around said standing part.

Further, in accordance with this invention, an eye splice is made with a cord of the hollow braid type by forming a bight in the free end of the standing part. The bight is inserted through the wall into the hollow center at an entry point and through the hollow center to a take-out point on the standing part. The loop of the bight is extracted through the wall at the take-out point leaving an overlap section of the standing part surrounding the bight between the entry point and the take-out point thereby forming an eye with the eye and the bight being on opposite sides of the overlap section. The standing part is passed through the loop of the bight and the bight is tightened around the standing part.

A complete understanding of this invention will be obtained from the detailed description that follows taken with the accompanying drawings.

BEST MODE FOR CARRYING OUT THE INVENTION

Figure 1:
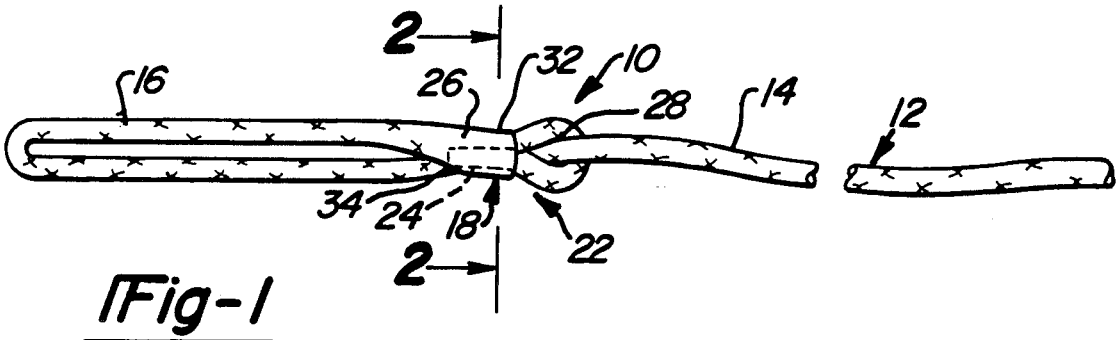
FIG. 1 shows the eye splice of this invention in its completed form.
Figure 2:
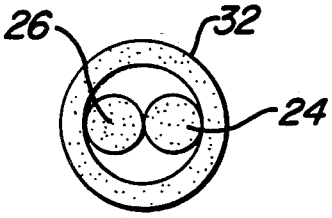
FIG. 2 is an enlarged cross-sectional view taken on lines 2—2 of FIG. 1.

Referring now to the drawings, there is shown an illustrative embodiment of the invention in an eye splice which is especially adapted for use with a cord of the hollow braid type and which is especially adapted for use in a parachute shroud. It will be appreciated, as the description proceeds, that the eye splice of this invention may be used with other types of cord and for many different applications.

The eye splice 10 of this invention as shown in its completed form in FIG. 1. The eye splice 10 is formed in the end of a cord 12 which is a hollow braid cord also known as a diamond braid or maypole braid cord. A cord of this type is typically constructed of eight, twelve or sixteen strands with a hollow center or core. This construction provides a tubular wall formed of the braided strands and a hollow center or passage extending axially of the cord.

The eye splice 10 formed in the cord 12 comprises, in general, a standing part 14 of the cord which terminates in a loop or eye 16 which is held fixed to the standing part 14 by a knot 18.

The knot 18 comprises a bight 22 formed in the end of the cord 14 by folding back the free end 24 of the bight alongside the standing leg 26 of the bight to form a cinch loop 28 of the bight. The free end 24 and the leg 26 of the bight 22 are disposed in the hollow center of an overlap section 32 of the cord which extends between an entry point 34 and a take-out point 36. The standing part 14 of the cord 12 passes through the cinch loop 28 of the bight 22. It will be noted that the application of a tensile force between the eye 16 and the standing part 14 tends to draw the cinch loop 28 tighter around the standing part 14 so that the resistance to slippage therebetween increases with increased tension.

Figure 3:
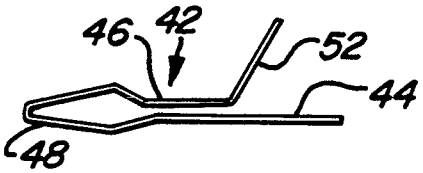
FIG. 3 shows a needle useful for forming the eye splice.

The eye splice of this invention, as described above, is made by the following method. The method will be described with reference to manually executed steps but it will be understood, as the description proceeds, that the method is well adapted to machine execution. The method to be described is preferably carried out with the aid of a latch hook or needle, preferably an open-eye needle 42 as shown in FIG. 3. The needle 42 is suitably constructed of bent wire and comprises a first shaft portion 44, a second shaft portion 46 and an eye 48 at the end of the two shaft portions. The first shaft portion 44 is a straight wire which serves as a handle and the second shaft portion 46 extends parallel to the shaft portion 44 and terminates an obliquely extending stop arm 52. The eye 48 is unitary with the shaft portion and is somewhat diamond shaped in order to permit ease of insertion and withdrawal from the braided wall of the cord 12. The stop arm 52 limits the extent of insertion of the needle 42 and ensures that the needle may be withdrawn without the free end of shaft portion 46 getting hooked into the braid of the wall.

Figure 4:
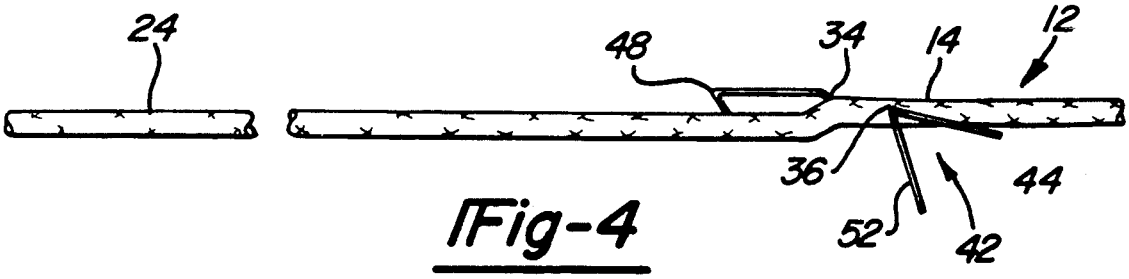
FIGS. 4 through s show successive intermediate stages of the eye splice in the process of making it from a piece of cord.

As shown in FIG. 4, the eye of the needle 48 is inserted into the standing part 14 of the cord 12 at a take-out point 36 which is several inches, say seven inches from the free end 24 of the cord. From the take-out point 36, the needle is passed through the hollow center of the cord toward the free end 24 and is extended through the braided wall on the opposite side of the cord at an entry point 34 at a distance, say about one inch, from the take-out point. Note that the insertion of the needle 42 is limited by the arm 52 and it can be readily retracted through the same passage through which it entered.

Figure 5:
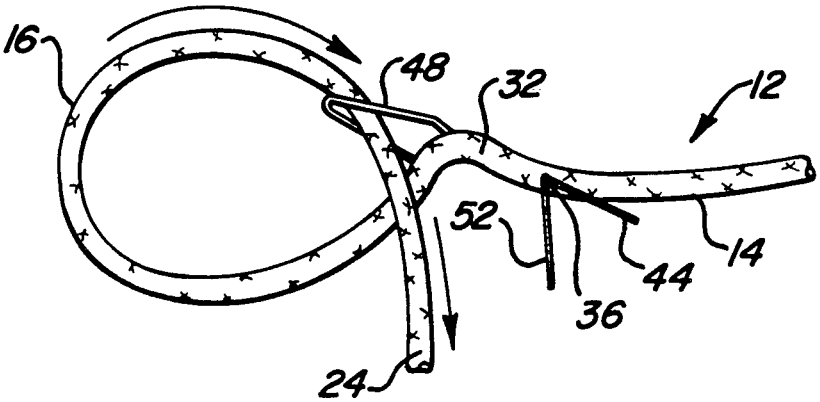

Next, as shown in FIG. 5, the free end 24 of the cord is folded back on itself and is passed through the eye 48 of the needle thereby forming the loop 16. It is noted that the loop is formed by passing the free end 24 through the eye 48 in the direction toward the overlap section 32, i.e. by moving the free end in a clockwise direction as viewed in FIG. 5. A length of cord say, one and one-half inches, is extended through the eye 48.

Figure 6:
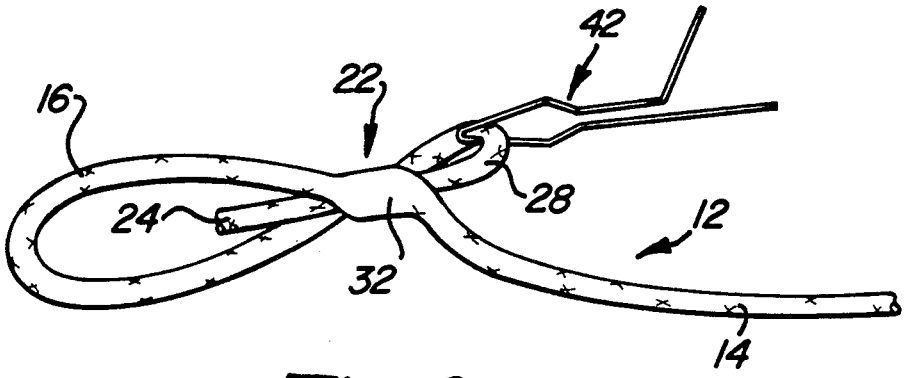
Figure 7:
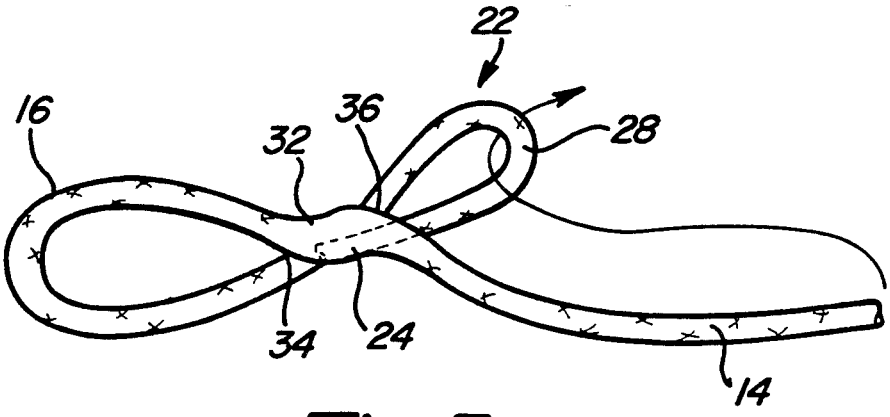

Next, the needle 42 is pulled back through the cord, as shown in FIG. 6, until the extremity of the free end 24 has just entered the hollow center of the cord as shown in FIG. 7. In this position, as shown in FIG. 7, the free end 24 of the bight and the leg 26 of the bight are surrounded by the overlap section 32 and the cinch loop 28 of the bight 22 extends beyond the overlap section 32. The loop 28 of the bight 22 and the eye 16 are disposed on opposite sides of said overlap section 32.

Figure 8:
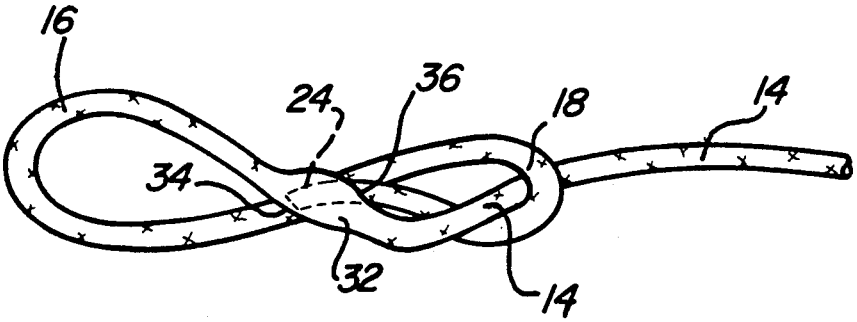

Next, the needle 42 is removed from the loop 28 of the bight 22 and the free end of the standing part 14, i.e. the opposite end of the cord 12, is passed through the loop 28 of the bight 22, as shown in FIG. 8. In this condition, the knot 18, formed by the bight 22 and the overlap section 32, is pulled tight by grasping the loop 16 (in the region of the point X in FIG. 8) and the standing part 14 of the cord and pulling in opposite directions until the cinch loop 28 of the bight 22 is closed tightly around the standing part 14 by sliding of the overlap section 32 and the free end 24 along the leg of the bight 26.

Although the description of this invention has been given with reference to a particular embodiment, it is not to be constructed in a limiting sense. Many variations and modifications will now occur to those skilled in the art. For a definition of the invention reference is made to the appended claims.

What is claimed is:

1. The method of making an eye splice in a cord of the hollow braid type, said cord having a tubular wall and a hollow center, said method comprising the steps of:

forming a bight in the free end of a standing part of the cord, inserting the bight through the wall on the standing part into the hollow center at an entry point and through the hollow center to a take-out point on the standing part, extracting a loop of said bight through said wall at said take-out point leaving an overlap section of the standing part surrounding the free end of said bight between said entry point and said take-out point, thereby forming an eye, and said eye and bight being on the opposite sides of said overlap section, passing the standing part through the loop of said bight, and tightening said bight around said standing part.

2. The method as defined in claim 1 wherein:

forming a bight includes the steps of inserting a needle eye-first through the wall on the standing part into the hollow center at said take-out point and extending it into the hollow center to said entry point and extracting the eye of the needle through the wall from said center at said entry point and inserting the free end of said cord through the eye of said needle and folding the free end back on itself, and the step of inserting the bight includes the steps of pulling the head of the needle, headlast said through entry point, through said overlap section and said take-out point.

3. The method as defined in claim 1 wherein:

the step of tightening comprises the steps of sliding said overlap section and said free end along said bight until the loop of said bight is tight around said standing end.

4. An eye splice in a cord of the hollow braid type having a tubular wall and a hollow center, said eye splice comprising:

a bight in the free end of a standing part of the cord, a loop between said bight and said standing part forming an eye, said bight extending through the wall on the standing part into the hollow center at an entry point and thence through the hollow center to a take-out point and thence through the wall at the take-out point with said free end remaining in said hollow center extending substantially to said entry point, and the standing part passing through said bight with the bight being tight around said standing part, whereby an eye splice is formed with said eye being fixed relative to said standing part.

* * * * *

UNITED STATES PATENT AND TRADEMARK OFFICE

CERTIFICATE OF CORRECTION

PATENT NO. : 5,062,344

DATED : November 5, 1991

INVENTOR(S) : T. F. Gerker

It is certified that error appears in the above-identified patent and that said Letters Patent is hereby corrected as shown below:

Column 2, line 19, delete "s" and insert -- 8 --.

Column 4, line 34, delete "said through" and insert -- through said --.

Signed and Sealed this

Second Day of March, 1993

*Attest:*

STEPHEN G. KUNIN

*Attesting Officer*

*Acting Commissioner of Patents and Trademarks*